US011406887B2

(12) United States Patent
Vollbrecht et al.

(10) Patent No.: US 11,406,887 B2
(45) Date of Patent: Aug. 9, 2022

(54) MULTIPLAYER, MULTISPORT INDOOR GAME SYSTEM AND METHOD

(71) Applicant: FlyingTee Tech, LLC, Tulsa, OK (US)

(72) Inventors: James Vollbrecht, Dallas, TX (US); Jeremy Mathew Carver, Millcreek, UT (US)

(73) Assignee: FlyingTee Tech, LLC, Tulsa, OK (US)

( * ) Notice: Subject to any disclaimer, the term of this patent is extended or adjusted under 35 U.S.C. 154(b) by 0 days.

(21) Appl. No.: 17/000,158

(22) Filed: Aug. 21, 2020

(65) Prior Publication Data

US 2020/0384343 A1 Dec. 10, 2020

Related U.S. Application Data

(63) Continuation-in-part of application No. 16/372,304, filed on Apr. 1, 2019.

(60) Provisional application No. 62/889,895, filed on Aug. 21, 2019.

(51) Int. Cl.

| | |
|---|---|
| ***A63B 71/06*** | (2006.01) |
| ***A63B 67/02*** | (2006.01) |
| ***A63B 71/04*** | (2006.01) |
| ***A63B 71/02*** | (2006.01) |

(52) U.S. Cl.

CPC ..... *A63B 71/0622* (2013.01); *A63B 67/02* (2013.01); *A63B 71/022* (2013.01); *A63B 71/04* (2013.01); *A63B 71/0605* (2013.01); *A63B 71/0616* (2013.01); *A63B 2071/0638* (2013.01)

(58) Field of Classification Search

CPC ... A63B 71/0622; A63B 67/02; A63B 71/022; A63B 71/04; A63B 71/0605; A63B 71/0616; A63B 2071/0638

USPC ..... 473/156

See application file for complete search history.

(56) References Cited

U.S. PATENT DOCUMENTS

2006/0287137 A1* 12/2006 Chu ..... A63B 63/00 473/422
2010/0009750 A1* 1/2010 Egozy ..... A63F 13/005 463/35
2013/0095959 A1* 4/2013 Marty ..... A63B 24/0084 473/448

(Continued)

FOREIGN PATENT DOCUMENTS

KR 101823433 B1 1/2018

OTHER PUBLICATIONS

International Search Report and Written Opinion of ISA/KR, PCT/US2020/047518.

*Primary Examiner* — John E Simms, Jr.
*Assistant Examiner* — Rayshun K Peng
(74) *Attorney, Agent, or Firm* — Crowe & Dunlevy, P.C.

(57) ABSTRACT

The invention relates to social activities typically based on physical manipulation of objects to achieve an objective common to the participants or to allow participants to engage in distinct activities on a shared field of play, part of which is physical and part of which is virtual and rendered on one or more displays. The invention provides a system and method to enable multiple participants (users) to engage in the activity sequentially or simultaneously, based on the context and objectives of the game. The activity includes one or many shared physical environments modeled on a computing system and displayed, in high fidelity, by one or more projectors or screens.

9 Claims, 12 Drawing Sheets

(56) References Cited

U.S. PATENT DOCUMENTS

| | | | | |
|---|---|---|---|---|
| 2017/0151484 | A1 | 6/2017 | Reilly et al. | |
| 2019/0099655 | A1* | 4/2019 | Park | A63B 69/3623 |

* cited by examiner

MULTIPLAYER, MULTISPORT INDOOR GAME SYSTEM AND METHOD

CROSS REFERENCE TO RELATED APPLICATIONS

The application is a continuation-in-part of U.S. patent application Ser. No. 16/372,304 filed Apr. 1, 2019, claims the benefit of and priority to U.S. Provisional Patent Application No. 62/889,895 filed Aug. 21, 2019, and incorporates by reference said nonprovisional and provisional applications in their entirety.

BACKGROUND OF THE INVENTION

1. Field of the Invention

This invention relates to social activities typically based on physical manipulation of objects to achieve an objective common to the participants. The invention provides a system and method to enable multiple participants (users) to engage in the activity sequentially or simultaneously, based on the context and objectives of the game. The activity includes one or many shared physical environments and virtual environments modeled on a computing system and displayed, in high fidelity, by one or more projectors or screens.

2. Description of the Related Art

As the power of modern computational and graphical processing units have increased, access to sports and related activities have become more realistic. Large-scale, "full size" sporting events are viewed with enhancements provided by real time tracking of participants, their inputs and the results; for example, televised hockey and golf feature tracers that give at-home spectators a view of the puck or ball not detectable by the naked eye. Simulations allowing participation of an at-home participant began with the simplest of input devices, such as handheld controllers, with the simplest of display devices, such as televisions. In the modern day, real-world games have evolved to include more sophisticated input devices by monitoring the participants' actions (e.g., Microsoft Kinect) and/or the results of their actions, such as the tracking of a soccer ball over a limited field of travel. The immediate benefit is to faithfully replicate unique and unusual physical environments of importance to a given sport or activity.

Despite attempts to create a shared environment and experience, there is currently no system that allows multiple players to physically participate in an activity with a shared objective in a shared space, or in series of activities with different objectives in a shared virtual field of play in a manner that allows social interaction between players in the physical space. Virtual and augmented reality technologies attempt to address this issue by sharing a simulated space or activity by way of closed-perspective inputs and outputs. Said differently, a participant is required to wear a helmet, visor, telemetry-tracked gloves, suit, instruments, etc. The result is a break between the shared-social element of the activity; the simulation requires interruption of the participants' interaction.

This invention overcomes these shortcomings by creating a partially simulated environment with a shared field of play for the activity that allows for an immersive but shared view of each participant and the other participants and their respective activity in the field of play, and further expands participation by combining the advantages of simulated display with a physical field of play. Moreover, there is no system of play that allows for such multi-user participation on the field of a virtual golf driving range.

Before proceeding to a detailed description of the invention, however, it should be noted and remembered that the description of the invention which follows, together with the accompanying drawings, should not be construed as limiting the invention to the examples (or embodiments) shown and described. This is so because those skilled in the art to which the invention pertains will be able to devise other forms of this invention within the ambit of the appended claims.

SUMMARY OF THE INVENTION

In general, the invention relates to social activities typically based on physical manipulation of objects to achieve an objective common to the participants. The invention provides a system and method to enable multiple participants (users) to engage in the activity sequentially or simultaneously, based on the context and objectives of the game. The activity includes one or many shared physical environments modeled on a computing system and displayed, in high fidelity, by one or more projectors or screens.

The foregoing has outlined in broad terms some of the more important features of the invention disclosed herein so that the detailed description that follows may be more clearly understood, and so that the contribution of the instant inventors to the art may be better appreciated. The instant invention is not to be limited in its application to the details of the construction and to the arrangements of the components set forth in the following description or illustrated in the drawings. Rather, the invention is capable of other embodiments and of being practiced and carried out in various other ways not specifically enumerated herein. Finally, it should be understood that the phraseology and terminology employed herein are for the purpose of description and should not be regarded as limiting, unless the specification specifically so limits the invention.

BRIEF DESCRIPTION OF THE DRAWINGS

These and further aspects of the invention are described in detail in the following examples and accompanying drawings.

DETAILED DESCRIPTION OF THE INVENTION

Figure 1:
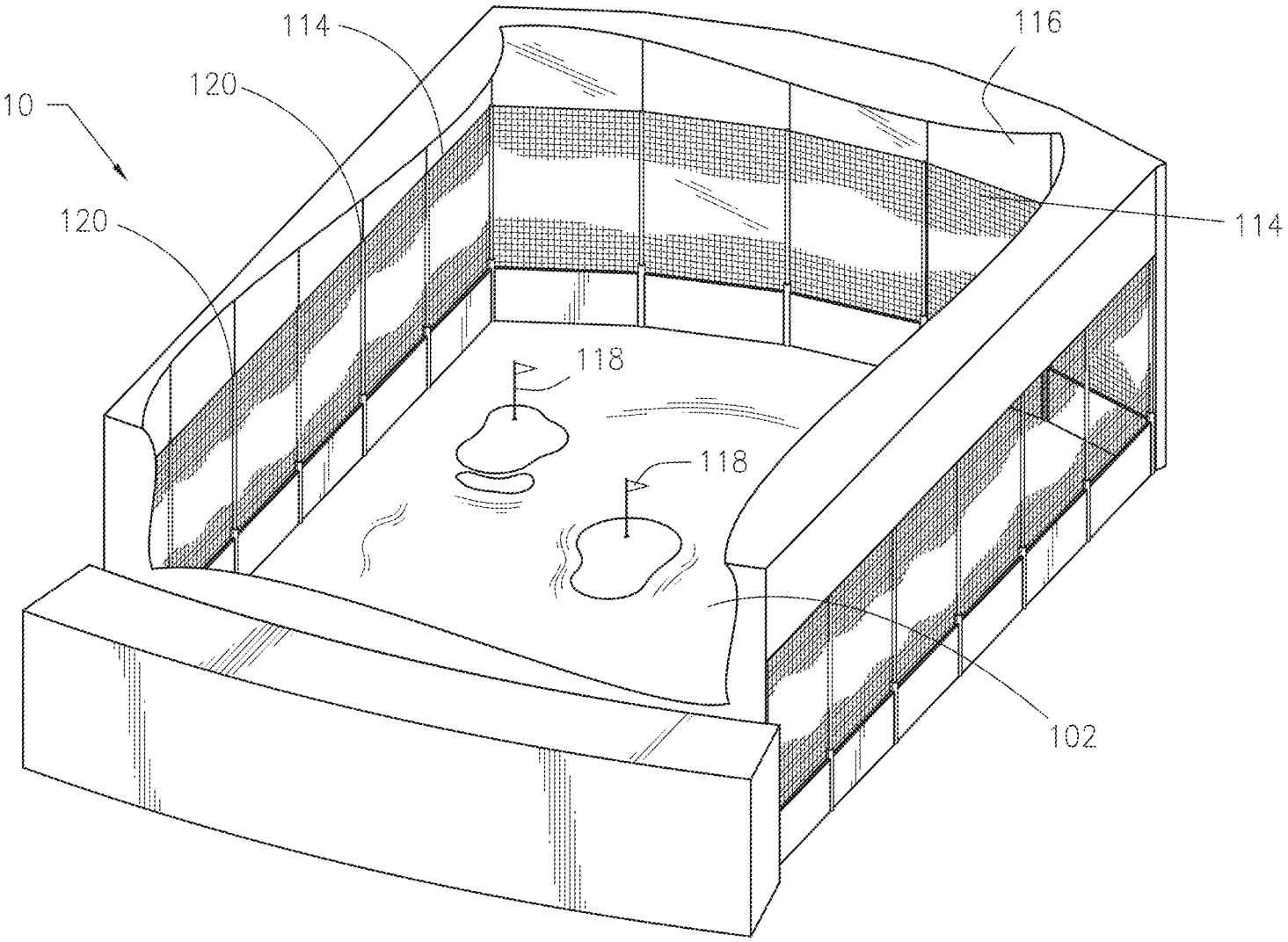
FIG. 1 illustrates a perspective view of an example of a multiplayer, multisport indoor game system in accordance with an illustrative embodiment of the invention disclosed herein. The area displayed in FIG. 1 is understood to be entirely indoors but could exist outdoors in a compact space.
Figure 2:
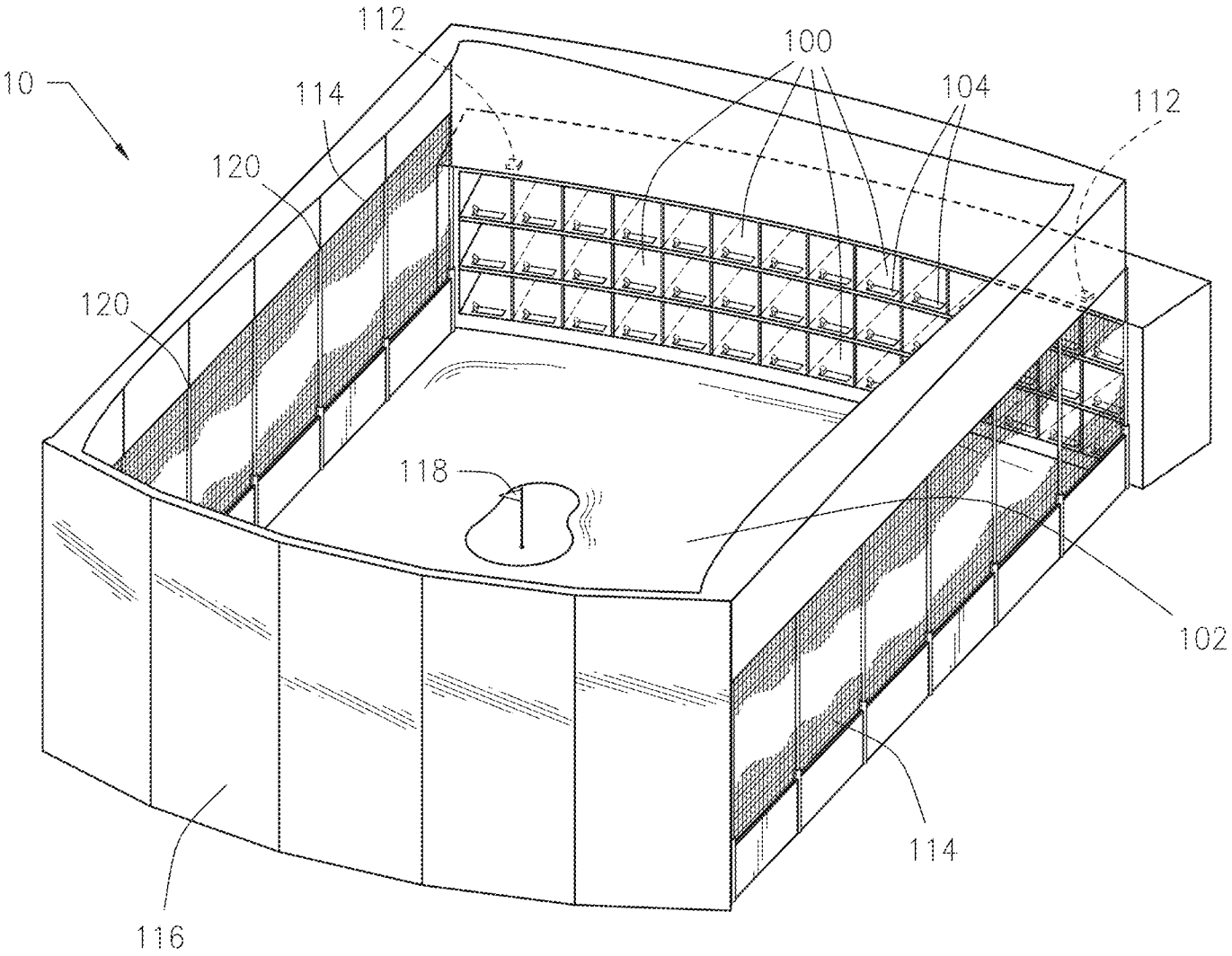
FIG. 2 is another perspective view of the multiplayer, multisport indoor game system shown in FIG. 1.

While this invention is susceptible of embodiment in many different forms, there is shown in the drawings, and will herein be described hereinafter in detail, some specific embodiments of the instant invention. It should be understood, however, that the present disclosure is to be considered an exemplification of the principles of the invention and is not intended to limit the invention to the specific embodiments or algorithms so described.

The invention generally relates to an multiplayer, multisport indoor game system and process having a dynamic range surface and/or range-surrounding display positioned at or near a terminal end of a field of play in order to significantly enhance the appeal and entertainment value of the activity and to enable completely novel objectives and games not possible with a static, three-dimensional physical field. The dynamic range surface and/or a dynamic, range-surrounding display provide for a partially simulated environment with a shared field of play for the activity that allows for an immersive but shared view of each participant and the other participants, and further expands participation by combining the advantages of simulated display with a physical field of play. In particular, the interactive range surface provides a visual, auditory and/or physical effect to a ball traveling over or landing on the range surface, and the range-surrounding display is configured to display the continued flight path of the ball.

The multiplayer, multisport indoor gameplay range, system and process is provided to simultaneously and dynamically display flight paths of multiple balls struck from a bay station in a sporting and entertainment facility. The bay stations may be located on a single story/level or on multiple stories/levels. The invention can include a system of embedded and projection-mapped images onto a large, multi-user game environment that corresponds to a simulated activity, such as a game or sporting event. While the range and the field of the multiplayer, multisport indoor gameplay system and process is illustrated herein as a driving range configured for golf, it will be understood that the game play system and process can be configured for a variety of rules, formats, and game-play environments and sports, such as golf, soccer (goal kicks, shootouts), football (field goals, throws), basketball, shooting and/or arcade games, etc. Multiple types of sports could be combined into a single game (e.g., skeet shooting at golf balls hit from other bay stations). The game play environment can be configured for individual free-play, game play between multiple players in a single bay station or game play between multiple players in multiple bays (or even by bay station level, e.g., first floor vs. second floor), or by and between all bays in the facility. The game play environment may also be configured for game play between players located in separate sporting and entertainment facilities. Moreover, the system and process allow multiple users to play on the same field but does not require the user(s) to be engaged in the same activity, and the game play environments can be synced between some or all bays and some or all players. The games could be timed or have a shot count, and the games could start/stop by bay station or by player. In addition, the user receives feedback from the simulated environment and the physical environment, and the game play environment and the bay stations allow for gallery participation and real-time feedback (social media, commentary, good shot! etc.).

In addition to simultaneous play, the range, system and process may allow for a mix of simultaneous and sequential play of games. In an embodiment involving a simulated round of golf, a large format view of the field of view provides all players with additional context and a sense for competitive position, even as they plan and execute their respective shots. The system and process provide for near-simultaneous play when relevant and sequential play when expedient. For example, with a tee shot the position players is common to all players. The large-format display enhances the mutual utility of the game by creating real-time competition. As each shot is hit, the track is displayed side by side with that of the other player. Unique perspectives required by players hitting from different tee boxes would be activated in sequence. As that player is activated in sequence, the displayed perspective would shift to the player farthest from the hole, with the position of all other players' shot positions displayed, and the trajectory of all prior players' shots shown in the air. Each player could plan their successive shot based on the success or failure of the player with the prior shot.

Referring now to the figures of the drawings, wherein like numerals of reference designate like elements throughout the several views, each bay station 100 in a golf and entertainment facility 10 is positioned behind a physical range surface 102 for game play. Each bay station 100 contains a striking, hitting or throwing zone 104, a ball dispenser 106, a game display(s) 108, programmable lighting (not shown), and/or an in-bay sensor system 110. The ball dispenser 106 is an in-bay ball storage device that dispenses balls at the user's request. The ball dispenser 106 can include a ball reader (not shown) configured to dispense the ball directly to the striking, hitting or throwing zone 104 or into an auto-tee (not shown) in the bay station 100. The ball reader can include one or more sensors that read a unique identifier via Bluetooth, RFID, visual inspection, or the like of the ball. The in-bay sensor system 110 is a sensor system providing striking/hitting-impact or throwing trigger event as well as initial launch parameters—ball speed, vertical angle, horizontal angle, and impact timestamp. The in-bay sensor system 110 may provide measured or estimated ball spin data as well as estimated trajectory information. Depending on the configuration, the in-bay sensor system 110 may be positioned in the striking, hitting or throwing zone 104, above the striking, hitting or throwing zone 104, or behind the striking, hitting or throwing zone 104 of the bay station 100.

The bay station 100 may also include the auto-tee, which is a programmable and adjustable height tee system integrated into the striking, hitting or throwing zone 104 and integrated with the ball dispenser 106 in the bay station 100. The auto-tee is controllable via software or physical buttons. The ball may be dispensed to the striking, hitting or throwing zone 104 directly from the ball dispenser 106 in response to a request by the user. In this configuration, the ball is released from the ball storage device, read using the ball reader, and then the ball is dispensed from an outlet the player in the striking, hitting or throwing zone 104.

During usage, the user will select a game or activity on the display 108 (e.g., heads-up display, touchscreen or the like) located in the bay station 100, or via their mobile device and an application linked to the venue and bay. In addition to game or activity selection, the display 108 shows individual player views, shots/balls in flight, recommended next shot/action, virtual game play environment, etc. A range visualization system loads the specific game or activity desired by the user. The ball will be dispensed from the ball dispenser 106 to the striking, hitting or throwing zone 104 in the bay station 100. When the ball is distributed to the user, the user will strike, hit or throw the ball to complete an objective of the game, sport, or activity. The ball's travel path (or lack thereof) will be tracked by the in-bay sensor system 110 and/or a range sensor system 112.

The range sensor system 112 can be positioned in the bay station 100, integrated into or on the ball, on the range surface 102, integrated into the range surface 102, and/or around the range surface 102. The range sensor system 112 is a system capable of measuring shots by fusing multiple overlapping sensor data streams into a three-dimensional volume representing the range surface 102 and virtual field of play. Flight trajectory data is available immediately (~hundredths of milliseconds) after trigger events. The range sensor system 112 is configured to simultaneously measure 100+trajectories from each of the bay stations 100 in real-time. The range sensor system 110 can include multi-sensor radars, multi-camera vision, ground impact sensors, and/or a fusion of multiple sensor systems. The initial launch data is used to begin altering the display(s), including the physical range surface and the rendered virtual field of play.

Figure 4:
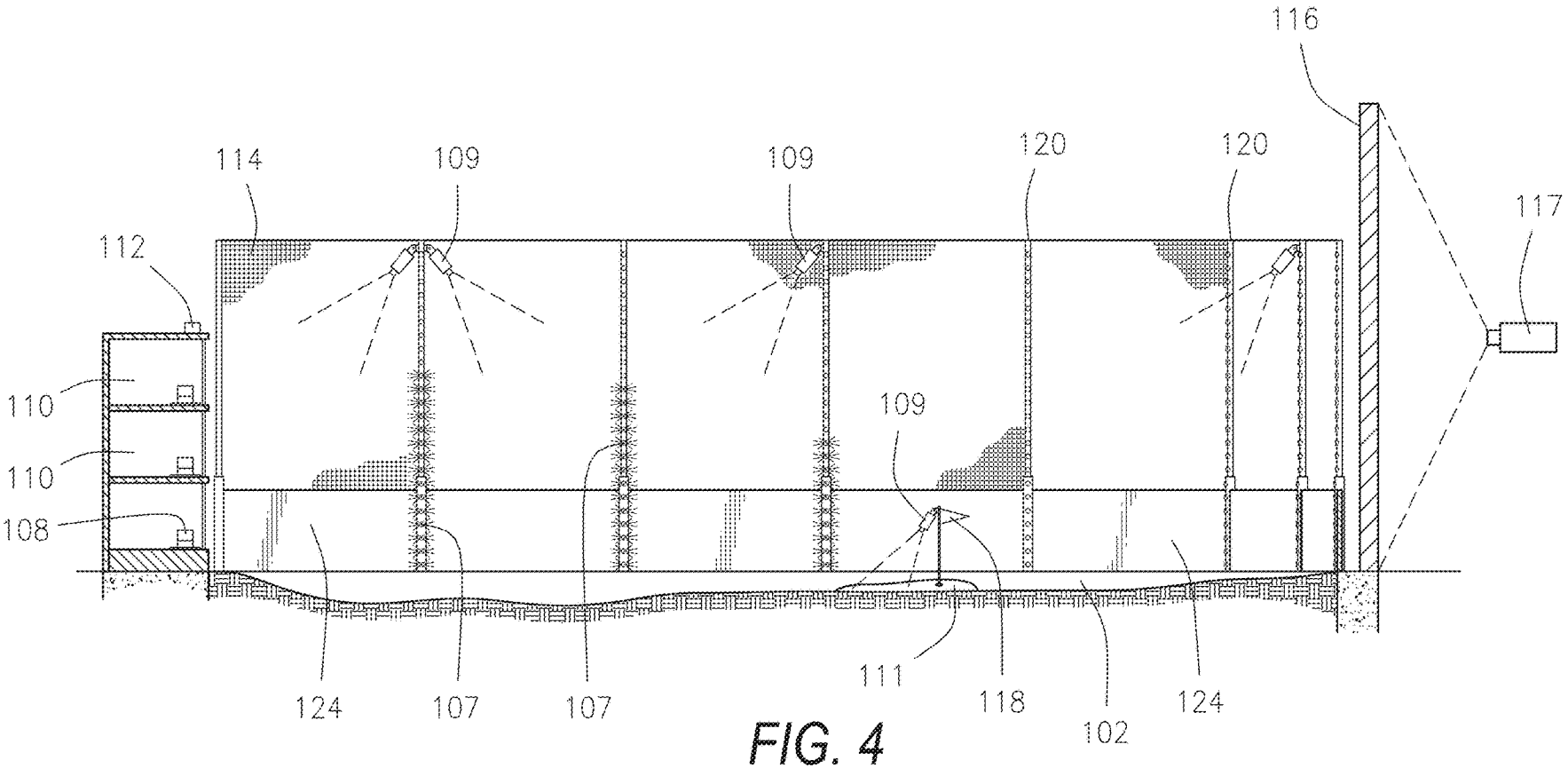
FIG. 4 is a cross-sectional view along line 4-4 of the multiplayer, multisport indoor game system shown in FIG. 1.
Figure 8:
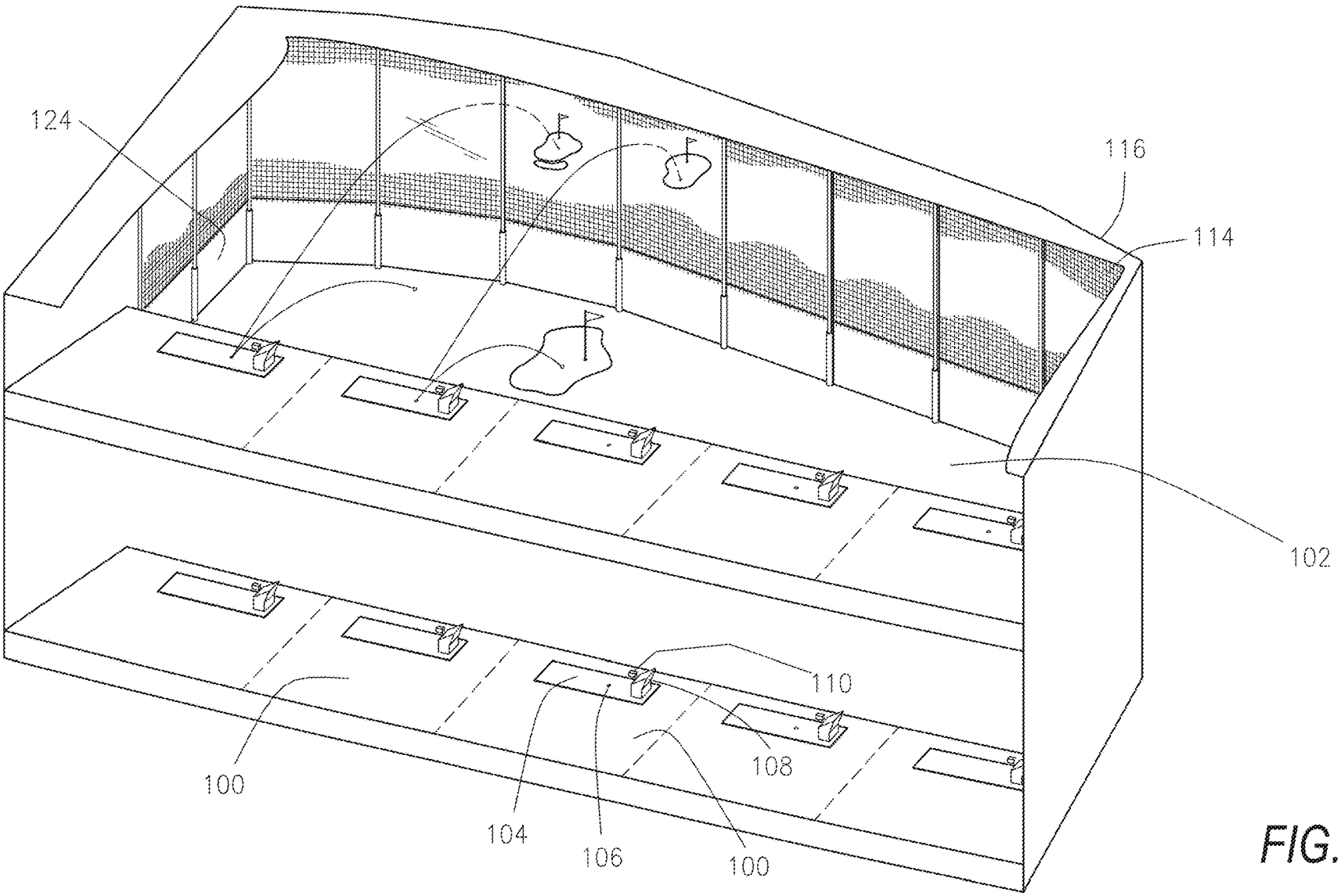
FIG. 8 is a perspective view of another example of a multiplayer, multisport indoor game system in accordance with an illustrative embodiment of the invention disclosed herein.

The physical range surface 102 extends from in front of the bay stations 100 and may be bounded by a range-surrounding dynamic and interactive display 116, which may be protected by a protective netting 114. As shown in FIGS. 1 and 8, the physical range surface 102 may vary in size. In each embodiment targets whether physical 118 or displayed on interactive display 116 can be incorporated into the overall display and game area for the golf and entertainment facility 10. The inventive range, system and process includes any hardware required to display a flight path over the range surface 102, contact with the range surface 102 upon landing, and/or the continued flight path of the ball after the ball hits the netting 114 or the range-surrounding display 116, and may include video projection mapping, embedded LED or other programmable light sources. The range surface 102 is the terrain portion of the range, which may contain one or more physical targets 118 and may be enclosed by the netting 114. The range-surrounding display 116 may be positioned behind the netting 114 at a terminal end and along the sides of the range surface 102, and can be configured to display the continued flight path of the ball after the ball hits the netting 114 or other aspects of the virtual, shared field of play. The range-surrounding display 116 can be a suitable projection display 117 or other display, such as LED or OLED, and can display a shared playing field and show the ball in flight for multiple simultaneous users. The range-surrounding display 116 and the terminal netting 114 can be mapped to a virtual target in the game play software and a range visualization system. Moreover, the protective netting 114 can supported by a series of support poles 120, and the netting 114 and/or poles 120 may also include physical targets (not shown). As illustrated in FIG. 4, the support poles 120 can include a series of controllable lights 122, and the range can also include at least one interactive range side surfaces or walls 124 intermediate of the poles 120 in order to extend separate or complementary virtual targets or effects from the range surface 102.

The physical targets 118 are structures on the range surface 102, the netting 114 or elsewhere that are electronically mapped as a virtual target in the common field of play by the range visualization system. All or a portion of the physical targets 118 can be stationary or mobile, and the physical targets 118 can include a ball reader for tracking shots.

Range surface 102 effects can also be driven from real-time video, pre-recorded sequences, as well as music and other event inputs. Embedded, digitally controlled lights 107, video projection devices 109, and/or other reactive surfaces may be located along the netting 114 and/or support poles 120 and/or physical targets 118 to provide game play objects 111 projected at least on the range surface 102. Video displays or programmable lights (e.g., LED or OLED) or other types of displays can be embedded within the range surface 102, the range side surfaces or walls 124, along a ceiling of the range surface 102, or outside of the range, such that they would provide specific information about the ball's final location via tracers or other visual, auditory or physical effects. In addition to lighting and video effects, physical effects on the range surface 102 may include but are not be limited to pyrotechnics, smoke or fog machines, water jets, fountains, and other special effects typically used to enhance the visual, auditory and/or physical experience. In addition, the range surface 102 can be configured for high and low light situations—day and night modes with different lighting, effects, and/or targets.

Figure 3:
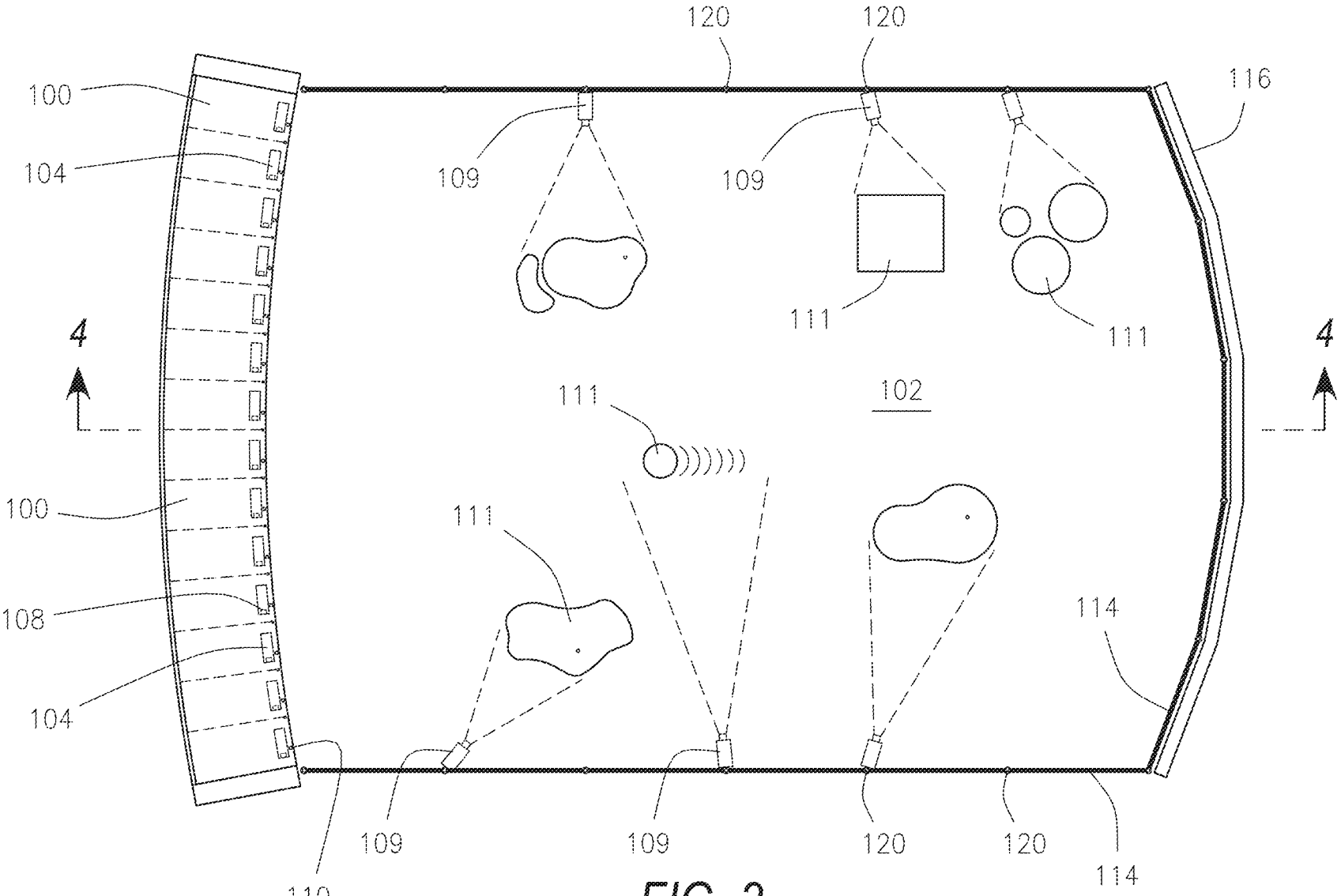
FIG. 3 is a top plan of view of the multiplayer, multisport indoor game system shown in FIG. 1.
Figure 5:
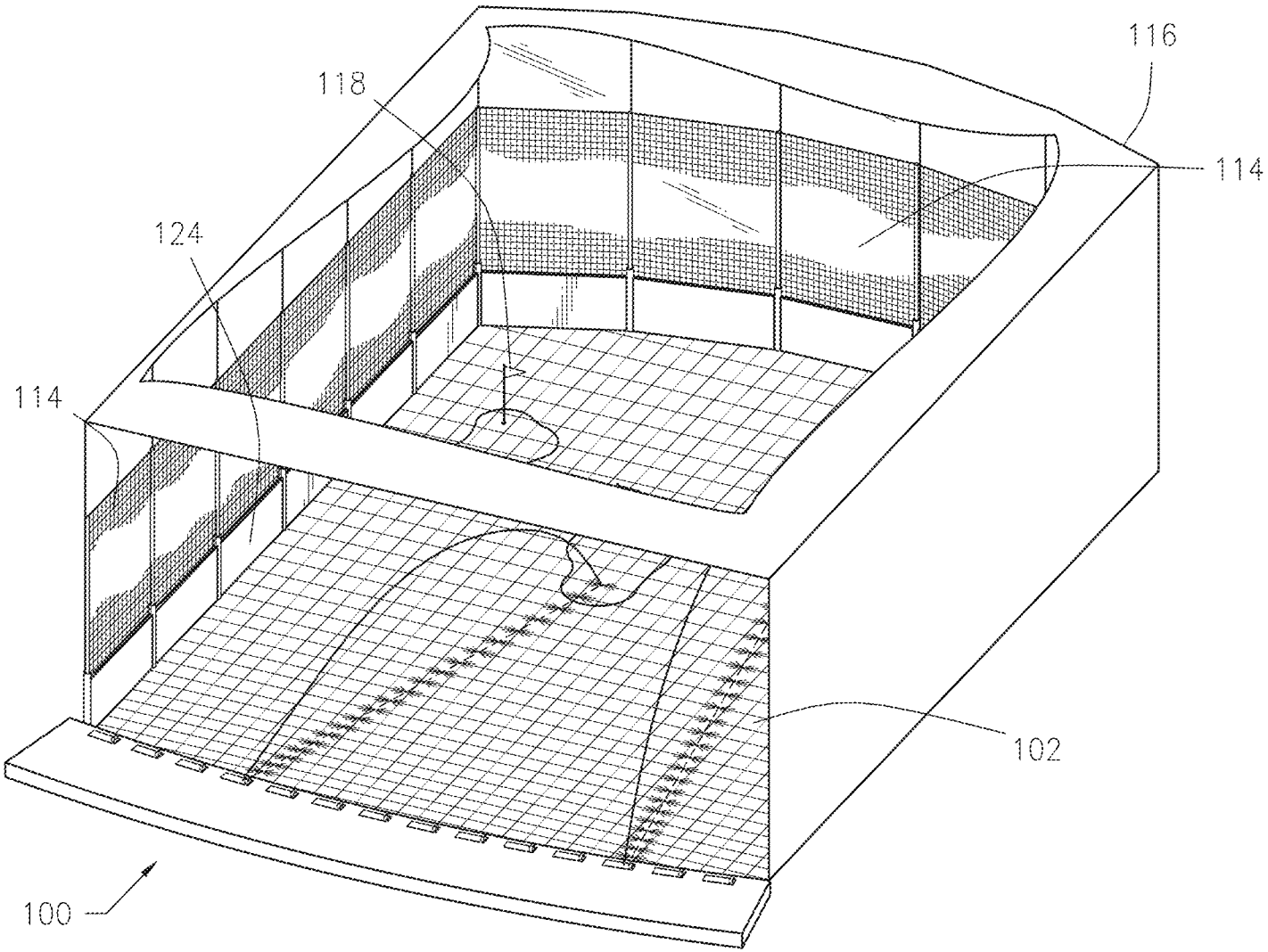
FIG. 5 is a perspective view of another example of a multiplayer, multisport indoor game system in accordance with an illustrative embodiment of the invention disclosed herein.
Figure 6:
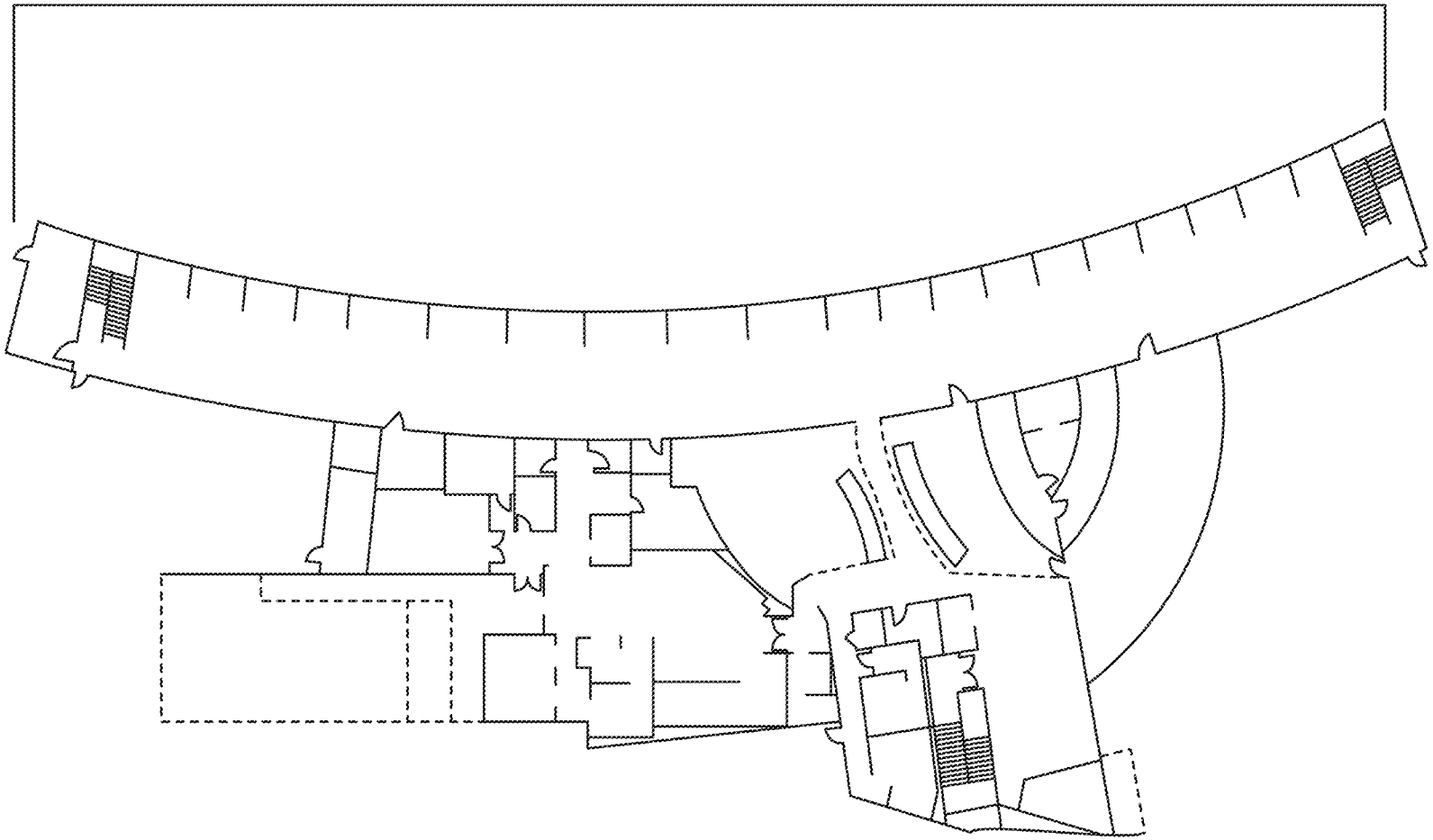
FIG. 6 is a top plan of view of an example of a gallery at a multiplayer, multisport indoor game system in accordance with an illustrative embodiment of the invention disclosed herein.

As exemplified in FIGS. 3 and 4, the range surface 102 can have the game play objects 111 dynamically projected/mapped directly onto the surface 102 in real-time using video projection devices 109 mounted to the support poles 120 and/or the physical targets 118. The range surface 120 can include a series of controllable light strips positioned on the range surface. The light strips can have a plurality of light-emitting diodes or other lighting mechanism (not shown) that can illuminate in a variety of colors. The light strips are arranged along an X-axis and a Y-axis and each of the diodes can be assigned a unique coordinate identifier (e.g., X1, Y1) that allows the range, system and process to illuminate a specific diode based on its position on the range surface 102. The resulting coordinate plane allows each location on the range surface 102 to be expressed as an X/Y coordinate. The diodes can be housed within a composite plastic tubing, and electrical wiring connects the diodes to a power source (not shown). As can be seen in FIG. 5, the proximity of the diodes can which are shown on the range surface 102 can coincide with the shot. The diodes may also be closer toward the bay stations 100 and spaced further apart down the range surface 102 towards the range-surrounding screen 116.

The relative coordinate positions of the diodes in the light strips are stored by the range visualization system in a display server and the ball flight coordinates (X, Y, Z and time) are stored by the range visualization system in a shot database. The range visualization system is configured to visualize game modes, scoring data, physical targets (mapped to virtual), purely virtual targets, range visualization and state, and physics simulation. Virtual targets are a virtual representation of the physical target 118 in the range visualization system, and the virtual targets can exist without requiring the physical target 118 on the shared, virtual range surface 102 (pure virtual target). In addition, the display server of the range visualization system handles bay state by logging users in and out, handling reserved bay time, requests for waiter, and other customer transactions. The display server also receives data about and controls the game or activity so that the visual, auditory or physical effect(s) on the range surface 102 and/or in the facility and/or in the bay station 100 is appropriately correlated to the user's input and success in achieving the objective.

During use, when a ball is hit, thrown or struck by a player from one of the bay stations 100, the in-bay sensor system 110 detects a trigger event (t), and the ball flight coordinates of the ball as it flies over the range surface 102 are detected by the range sensor system 112. The range visualization system aggregates game play parameters, trigger event data and ball flight coordinates from each of the sensor systems (e.g., in-bay sensor system 110 and range sensor system 112) for each of the bay stations 100. The in-bay display 108 shows a virtual game play environment that can mirror the range surface 102 or can show a completely virtualized game play environment. The range views are synchronized by the range visualization system so that events being seen down the range surface 102 are displayed virtually in the bay station 100. Over-time, the range visualization system will map and record observed launch parameters and flight data to allow rapid flight prediction that is then linked to display surfaces, projectors, LED lights, etc. to allow for display to occur as the ball physically travels near said displays and lights.

Figure 7:
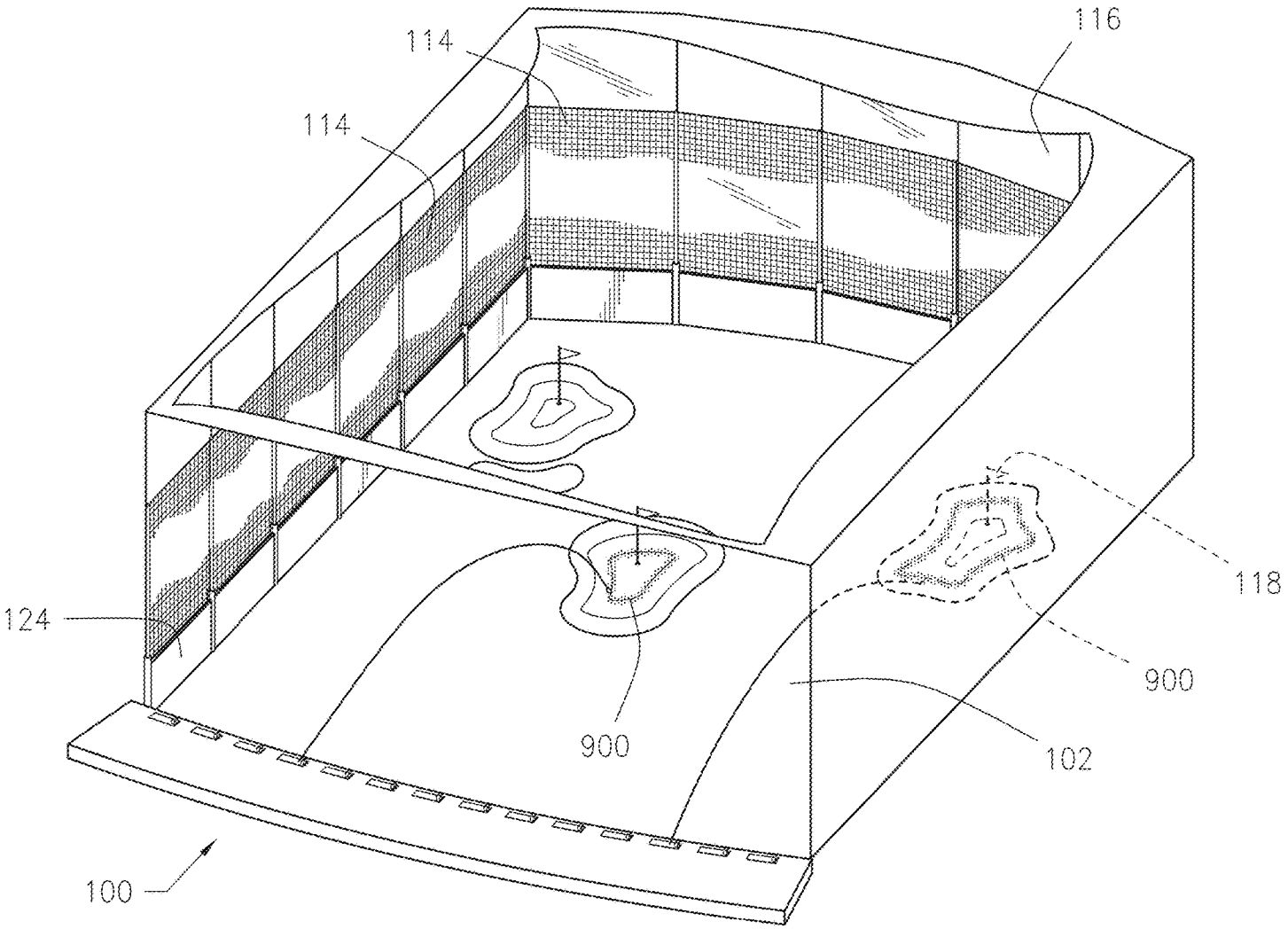
FIG. 7 is a is a perspective view of another example of a physical playing field having a dynamic, interactive range surface that provides a visual, auditory and/or physical effect from a golf ball on the playing field in accordance with an illustrative embodiment of the invention disclosed herein.

In addition as the ball travels to one of the physical targets 118, the range visualization system can direct one or more effects to display the path of the ball on the range surface 102, for example, in a color that is unique to that user or bay station 100. When the user successfully hits a target area 900, additional changes to the range surface 102, such as a rippling effect (e.g., FIG. 7), can be displayed on the target area 900. In addition, an audible reaction in the bay station 100 may be played to indicate success or failure, and the hue of the light in the bay station 100 may be changed as well. The golf and entertainment facility 10 may also include a gallery 12 positioned behind the individual bay stations 100. The gallery allows viewers to access and view the bay stations 100. The position of the gallery 12 allows viewers to spectate the game play in the bay stations 100, on the range surface 102, and on range-surrounding display 116, or otherwise displayed in the golf and entertainment facility 10.

Figure 9:
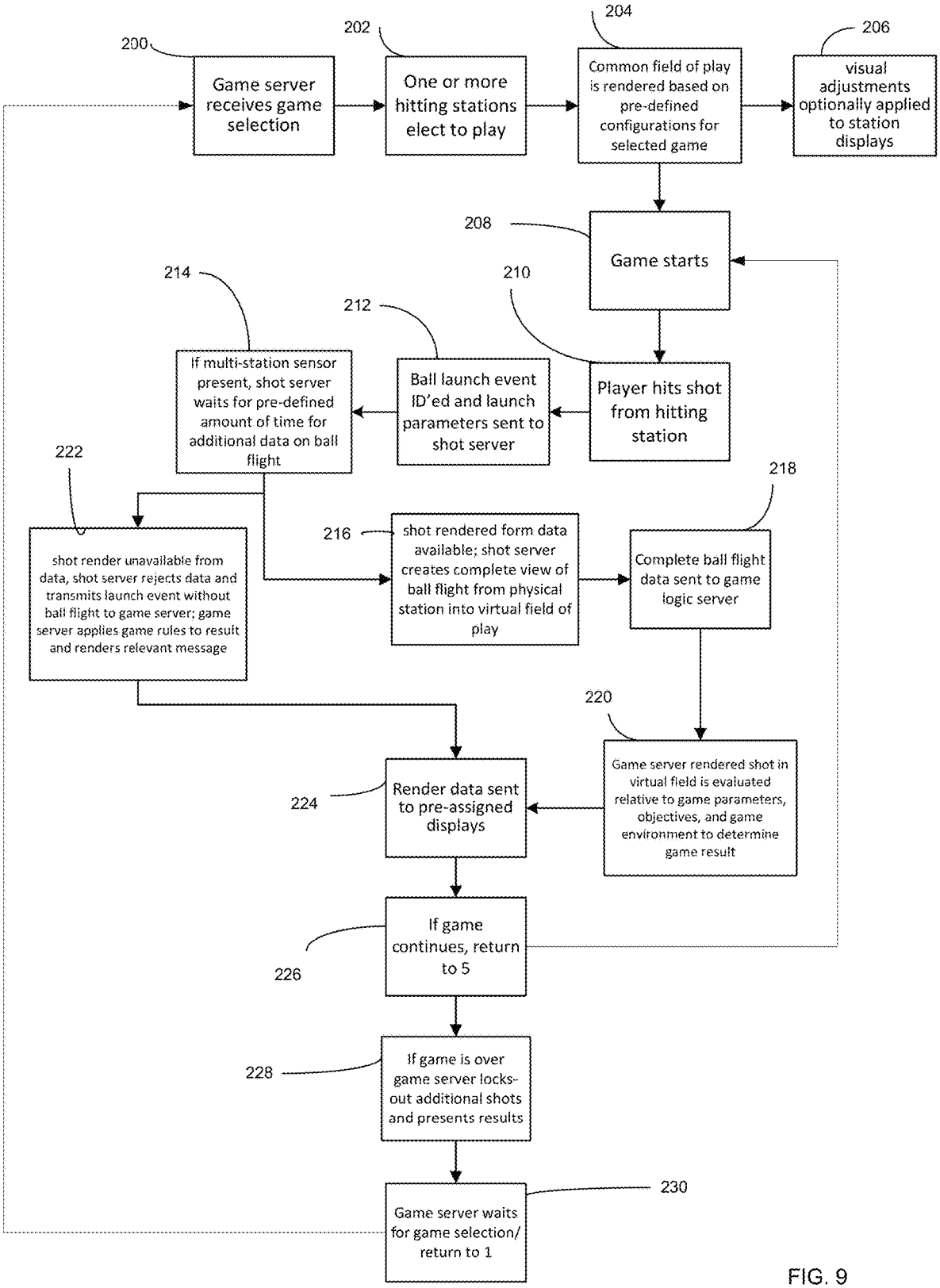
FIG. 9 is a flow chart of a synchronous game play method employed in a multiplayer, multisport indoor game system in accordance with an illustrative embodiment of the invention disclosed herein.
Figure 10:
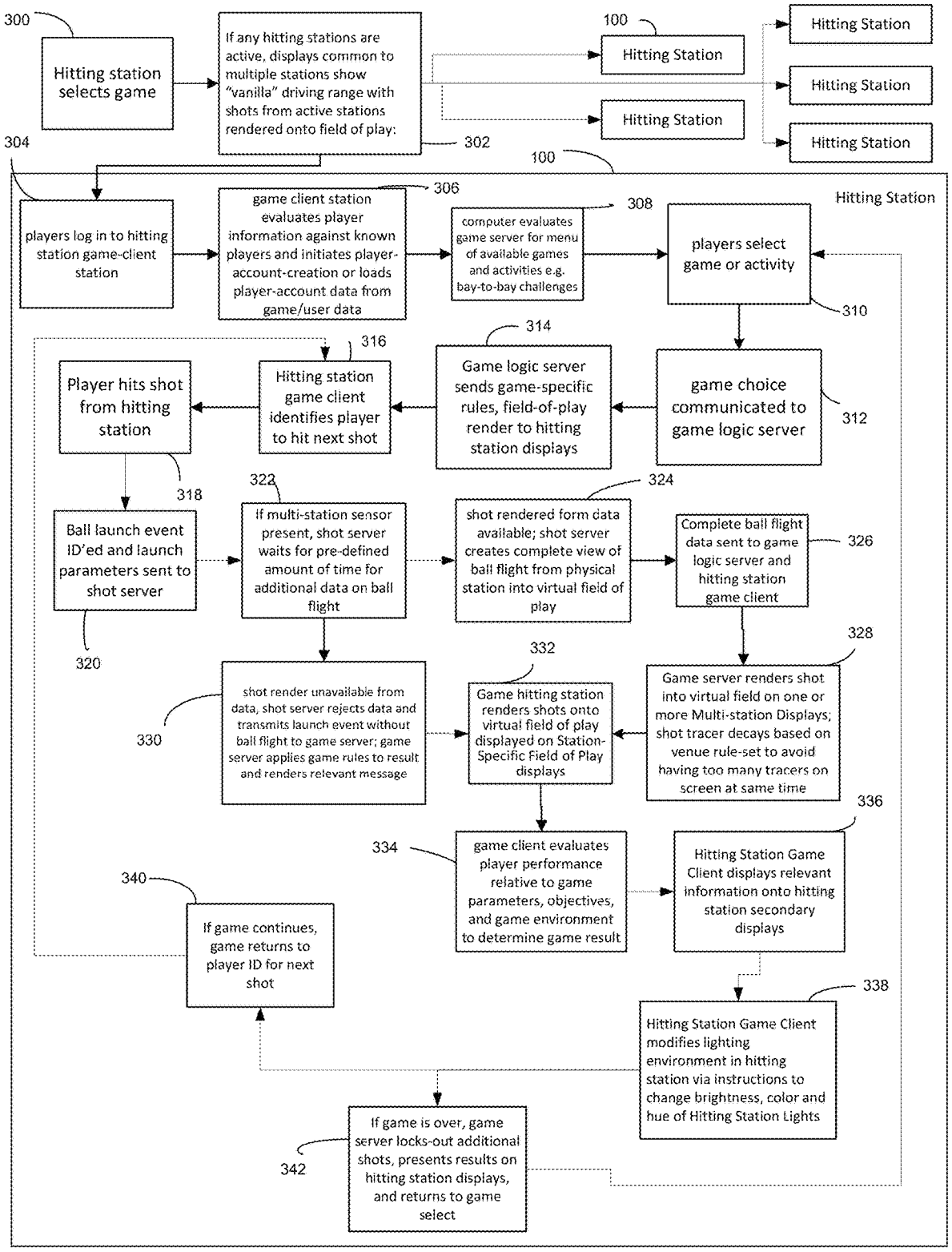
FIG. 10 is a flow chart of an asynchronous game play method employed in a multiplayer, multisport indoor game system in accordance with an illustrative embodiment of the invention disclosed herein.
Figure 11:
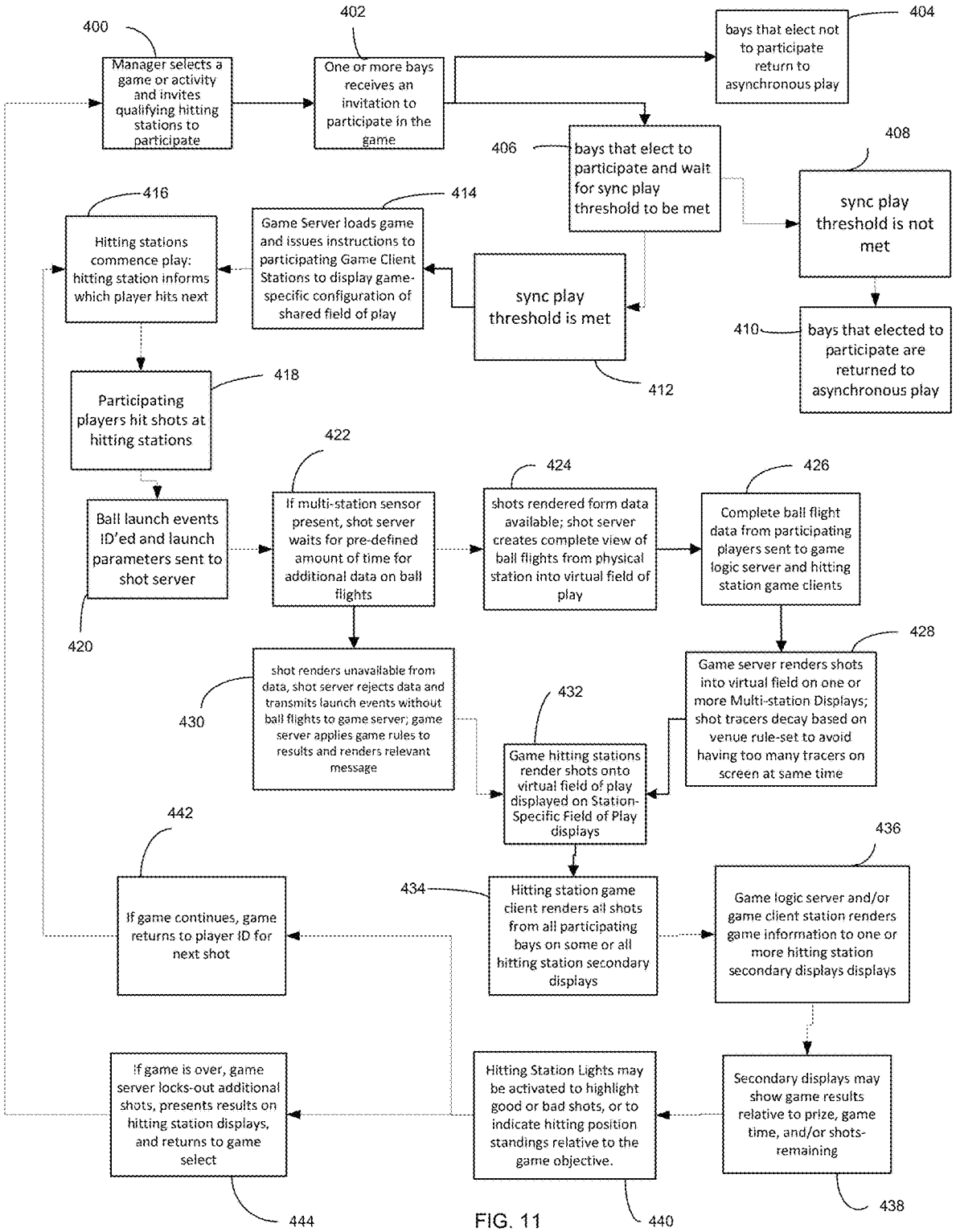
FIG. 11 is a flow chart of a partial synchronous game play method employed in a multiplayer, multisport indoor game system in accordance with an illustrative embodiment of the invention disclosed herein.

Turning now to FIGS. 9, 10, and 11 shown therein are shown synchronous, asynchronous, and partial synchronous methods of gameplay which can be employed within the golf and entertainment facilities 10 described above. These methods of gameplay within the golf and entertainment facility 10 allow for multiple players of a game or sport to play simultaneously from designated bays 100 onto a shared field of play. This field of play may include a physical game area which may include a range surface 102 which incorporates physical targets 118 and the end of range screen 116. The end of range screen 116 can display a digital game area through displayed digital game play objects 111. Using the digital and physical game areas in this manner allows a game's field of play to be smaller than the given sport or activity's standard field of play allowing users and players more flexibility in playing the given sport. In some embodiments, players interact in gameplay and with each other via separate golf and entertainment facilities 10 which can separately display a shared field of play for each player. In these embodiments data regarding a player's interaction with the game can be shared between the golf and entertainment facilities 10. The primary setting for this invention and field of play is indoors, and consists of one or more bay stations 100, one or more sensors 110, 112 to track the player's activity and/or shots, nets 114 that limit the travel of the player or the player's ball, screens 116 that can display digital game play objects 111 and other game elements, a computer to calculate and predict the end-result of the player's activity or shot, light or laser video projectors 109 to display the field of play and player's activity, shots, etc., and environmental lighting 107 to provide additional information or illumination in the limited physical space shared by the players.

Figure 12:
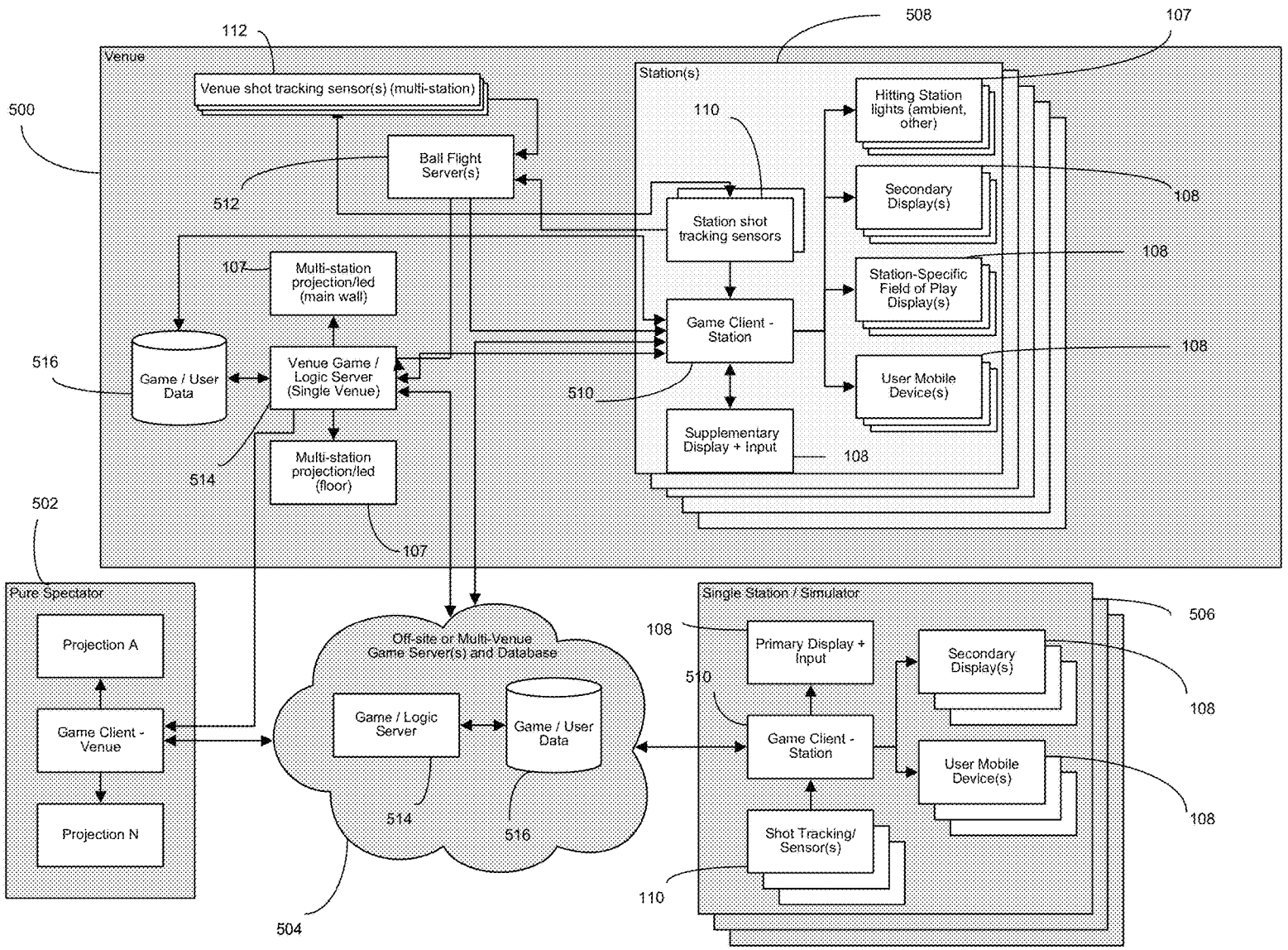
FIG. 12 is an example of a system architecture in which the gameplay methods described in FIGS. 9, 10, and 11 can be deployed in accordance with an illustrative embodiment of the invention disclosed herein.

Turning now to FIG. 12 an embodiment of a system in which the gameplay methods described in FIGS. 9, 10, and 11 can be deployed is shown. The system includes a venue 500 which may be a golf and entertainment facility 10, a pure spectator 502, an offsite game server 504, and a single station simulator 506. Connections between these elements and sub elements in the system are shown with connecting arrows. The connections may be used to send or receive data or commands between the elements and sub elements in the system. The venue 500 includes stations 508 which may be bays 100 that include various displays 108 connected to a game client station 510. The stations 508 also include station shot tracking sensors or an in bay sensory system 110. The venue 500 further includes a venue shot tracking sensor or range sensor system 112 connected to the in bay sensory system 110 and to a ball flight server 512 to provide renderings of ball flights. Also connected to the stations 508 is a game logic server 514. The game logic server 514 is connected to multi-station projection LEDs or controllable lights 122 which may be positioned on range walls 124 or a range surface 102. The system venue 500 also has stored user data 516 which may provide information about the players to the system via the game logic server 514. The offsite game server 504 may also have a game logic server 514 and store user data 516 to supplement the data stored in the venue 500. The single station simulator 506 may include various displays 108 connected to shot tracking sensors or an in bay sensory system 110. In this manner the single station simulator 506 operates in a manner similar to the venue 500 stations 508 but without the aid of a range sensor system 112. In this manner FIG. 12 shows an embodiment of the system which may be used to facilitate the gameplay methods of FIGS. 9, 10, and 11. The applications of the system shown in FIG. 12 and its elements and sub elements are shown in the descriptions of the gameplay methods of FIGS. 9, 10, and 11.

In the gameplay methods of FIGS. 9, 10, and 11 the computer system renders the digital game arena or playing field such as a driving range on a large screen, giving each player a view of some or all of the field of play. The digital game arena may be combined with a physical game arena shown and described above to produce the field of play. Each player's shot is tracked by observing a combination of (1) club data which may include club swing path, angle of attack, face orientation before, at and after ball strike, club speed and other information; (2) ball launch data, which may include vertical launch angle, horizontal launch angle, ball speed, ball side spin, ball back spin and other information; and (3) actual ball flight data, which may be described by a three dimensional x-y-z position grid and ball locations within the grid and time to determine travel of the ball within the grid relative to the hitting position over time. These observed parameters exist only until the ball hits a screen 116 or net 114. The observations are reported to a computer system specific to each hitting station or to a computer shared by all hitting stations. The computer system then provides a time-based location of the ball to controllers that may illuminate the path of the ball from the hitting position to the screen 116 or net 114, and thereafter, to one or more video projectors 109 that render the ball within the shared field of play. A computer-rendered ball with a flight-path-tracer are rendered from the impact point on the net 114 or screen 116 into the digital game area. In this manner both a physical game area, which may include the range surface 102, physical targets 118, and an area enclosed within range walls 124 and a digital game area which displayed on the screen 116 allow users to interact with other users on the field of play.

Turning now to FIG. 9, a method of synchronous play is shown and described. Synchronous play involves all players and bays 100 at one or more golf and entertainment facilities 10 playing the same game or activity with a shared objective. Each player is competing directly with the other players or groups of players in bays. An example would be a game requiring players to "capture" an area of the shared field of play by landing a ball closer than any other player to the flag, physical target 118, digital target, or game play object 111 in that area of the shared field. The game would typically begin at the same time for all players, and players would be able to observe their shot from their bay 100 and result on a screen 116 alongside that of other players. An area of the field controlled by a given player would earn that player a fixed number of points each minute they control that area until either the end of the game or until a different player lands their ball closer to the flag in that area of the field. Multiple people playing from hitting areas near each other, into a screen 116 that renders all player's shots in real time creates an enhanced competitive dynamic and excitement for participants and observers located in a gallery 12. Other examples of synchronous-play activities might reward players for how many shots are taken in a given period of time, how far a ball travels with a limited number of shots, or require players to execute shots towards a sequence of system or user-designated targets with a limited number of shots or within a limited time period.

As shown in FIG. 9, the process for synchronous game play method begins with step 200 wherein a game server receives game selection from a player or game manager. The player may enter a game selection on a display 108 located in a bay 100. After the game is selected, the process proceeds to step 202 where users in one or more hitting stations located in each of the bays 100 elect to play the game. The users again may elect to play the game by interaction with a display 108 in the bay 100. It will be understood that the displays 108 can be used by the players to input selections, information, and user profiles into a game server or system. After the hitting stations have elected to play a common field of play is rendered based on pre-defined configurations for selected game in step 204. The common field of play may be displayed on the displays 108 or on the end of range screens 116. As shown in step 206 visual adjustments specific to active player such as a handicap, may also be presented to each hitting station and applied to common field of play via the end of range screens 116 and/or to displays 108 in the bays 100.

After the common field of play is established by the system the game starts in step 208 and in step 210 a player can hit a shot from a hitting station in a bay 100. When the player hits a ball, the hitting station identifies the ball launch event and sends launch parameters to shot server in step 212. If a multi-station sensor is present when the ball is launched, then in step 214 the shot server will wait for pre-defined amount of time for additional data on ball flight. The data from the ball flight and ball launch may be collected by a range sensor system 112 and an in-bay sensor system 110. If available ball launch and ball flight data is sufficient for a shot to be rendered by the system, then the shot server will render the shot in step 216. The shot server creates the render or complete view of the ball flight from the hitting station within the bay 100 through the physical game area and into the virtual field of play or digital game area. After the shot is rendered, the process proceeds to step 218 where the complete rendered ball flight data is sent to a game logic server. In step 220 the game logic server takes the rendered shot and evaluates the shot relative to game parameters, objectives, and game environment to determine game result from the rendered shot. The process then will proceed to step 224.

If after step 214 data is not available to allow a shot to be rendered, then in step 222 the shot server rejects the insufficient available data and transmits the launch event to the game server without a rendered ball flight and the game server applies game rules to generate an in-game result (e.g., the player loses a turn, or receives no points). The process will then skip to step 224. In step 224 render data from the corresponding shot and launch event are sent to pre-assigned displays 108. If the process followed step 222 then step 224 may entail rendering a shot message relevant to the failed shot onto a display. If the process followed step 216 then step 224 may entail rendering a shot onto a display. The displays may include station specific field of play displays, an end of range screen 116, a hitting station display 108, a hitting station specific secondary display, other venue data displays which generally show other game information such as game score, active players and stations and related statistics. The displays receiving render information may also include the player's mobile devices. After the render data has been sent to the pre-assigned displays, the game may continue in step 226 by returning to step 208 and continuing the process forward from step 208. When the game has ended, the process will proceed to step 228 wherein the game server locks-out additional shots and presents the final results to the players. In some embodiments the game may be ended by a set amount of time passing, a threshold score being reached, or a threshold number of shots being hit. When the game has ended the Game server waits for another game selection in step 230 which will restart the game by returning the process to step 200. In this manner one embodiment of a synchronous game play method in a golf and entertainment facility 10 is shown.

Turning now to FIG. 10, an asynchronous method of gameplay is shown. Asynchronous play allows each hitting station to play a game that is unique to that hitting station or bay. In this manner each hitting station in a golf and entertainment facility 10 can play a different game. The golf and entertainment facility 10 allow for players at different hitting stations and bays 100 engaged in asynchronous play to still play on a shared field of play, thereby enhancing the gaming experience. In asynchronous play one a hitting station in a bay 100 may elect to play a game of darts. In darts each player in the bay 100 hitting station has five shots and each shot is scored by how close the ball lands to objects in the digital game area or virtual field of play. After the shots are completed the player with the most points wins the game. In a multi-player indoor golf range, the common display such as the end of range screen 116 would show the game play objects 111 in the field of play for the dart game and the shots from each player from the dart game. One or more displays 108 in the bay 100 playing the dart game would offer a modified view of the field of play specific to the bay's 100 dart game. This modified view may include a field of play with concentric circles around each object in the field of play indicating the value of landing a ball in that area.

While the dart game described above is being played in one bay 100, another game may simultaneously be played in other bays 100. For instance, another bay may elect to play a card game of twenty-one. In this instance the objects in the field may be displayed as cards on the displays 108 in the bay 100 playing the card game. In this example, the objective of the game is for each player to gather cards by hitting the game play objects 111 or range surface or boundaries in the common field of play, which are mapped to cards on the displays 108 in the bay 100 for this game. At the end of the game, the player whose cards sum closest to twenty-one without exceeding twenty-one, wins the game. As described above, in asynchronous play the players in the two separate bays 100 can have completely different gaming experiences while still sharing a common field of play. Despite playing completely different games, players in the two bays 100 see each shot extend into the rendered, virtual field of play and the overall experience for each player is enhanced as players can immediately observe the quality of the shot of players in other bays playing other games. Moreover, players may be enticed to join other bays 100 for synchronous play of a game between two or more bays 100. Such bay-to-bay synchronous play allows players in a hitting station to challenge players in another bay 100. Both bays 100 can observe progress in the game from a shared visualization of the common field of play and from station-specific displays that show their bay's 100 progress in the game vs. the other bay's 100 progress.

As shown in FIG. 10, the process for an asynchronous game play method begins with step 300 wherein a hitting station in a bay 100 receives a game selection from a player or game manager. As shown in step 302 the game server checks at this point if any hitting stations are active. If there are other active hitting stations the game server may display a common visual such as a driving range with game play objects 111 on the end of range screen 116. Game play objects rendered onto the common visual may include flags, nets and other simulated physical objects, as well as advertisements, logos, and adjustments to the visuals for the time of day, or weather. Shots from active bays 100 will be rendered onto the common field of play shown on the end of range screen 116. The common visual may be used by any bay 100 in this manner, while game specific game play objects 111 are shown on displays 108 in each bay 100.

When the game server has set up the hitting stations and bays 100 for asynchronous play, a single hitting station may proceed in with asynchronous play as shown in step 304, where a player logs into the game client station of the hitting station. After the player logs in, the method proceeds to step 306 where a game client station will evaluate the player's information against known players and either initiate a player-account-creation or load the player's account data from stored game and user data. Then in step 308 the bay 100 computer pulls stored data from the game server to display a menu of available games and activities. These games and activities may include bay-to-bay challenges and the ability to make the players in a bay 100 available for bay-to-bay challenges. In step 310 the player selects a game or activity from the available list and in step 312 the displays 108 communicate game choice to a game logic server. The game logic server then in step 314 sends game-specific rules and the field of play render to displays 108 in the bay 100. For example if the player selects the game twenty-one, the game play objects 111 shown on the common end of range screen 116 are shown modified on the bay 100 displays 108 to show the required card graphics corresponding to game play objects 111 on the end of range screen 116.

With the game now presented to the players, the process proceeds to step 316 wherein the game client identifies a player to hit the next shot from the bay 100. The selected player then hits the shot in step 318. When the player hits a ball, the hitting station identifies the ball launch event and sends launch parameters to shot server in step 320. If a multi-station sensor is present when the ball is launched, then in step 322 the shot server will wait for pre-defined amount of time for additional data on ball flight. The data from the ball flight and ball launch may be collected by a range sensor system 112 and an in-bay sensor system 110. If available ball launch and ball flight data is sufficient for a shot to be rendered by the system, then the shot server will render the shot in step 324. The shot server creates the render or complete view of the ball flight from the hitting station within the bay 100 through the physical game area and into the virtual field of play or digital game area such as onto the end of range screen 116. Rendered shots will decay based on a game server rule which is set to avoid having too many shots on a screen at same time. After the shot is rendered, the process proceeds to step 326 where the complete rendered ball flight data is sent to a game logic server. In step 328 the game logic server takes the rendered shot and evaluates the shot relative to game parameters, objectives, and game environment to determine game result from the rendered shot. The process then will proceed to step 332.

If after step 322 data is not available to allow a shot to be rendered, then in step 330 the shot server rejects the insufficient available data and transmits the launch event to the game server without a rendered ball flight and the game server applies game rules to result the launch event. The process will then skip to step 332. In step 332 render data from the corresponding shot and launch event are sent to pre-assigned station specific displays1 108. If the process followed step 330 then step 332 may entail rendering a shot message relevant to the failed shot onto a display 108. If the process followed step 322 then step 332 may entail rendering a shot with corresponding game elements onto display 108 in the bay 100. This may also be rendered on other displays such as a user's mobile device. The shot with corresponding game elements however will not be rendered onto the common display such as an end of range screen 116 as is done in synchronous gameplay because asynchronous game specific elements are only shown to each bay. After the game specific render data has been sent to the bay 100 displays 108, the method will continue to step 334. In step 334 the game client evaluates player performance relative to game specific parameters, objectives, and game environment to determine game result. Then in step 336 the game client displays relevant game information regarding this game result on secondary displays such as displays which generally show other game information such as game score, active players and stations and related statistics, as well as user mobile devices. Next the method proceeds to step 338 wherein the game client may modify the lighting environment in the bay via instructions to change brightness, color and hue of bay 100 lights in response to good or bad game results.

The game client will then either continue the game via step 340 or end the game via step 342. Step 340 returns the process to step 316 and continues the process forward from step 316. Step 342 ends the game by the game server locking-out additional shots and presenting the final results to the players via the bay displays 108. In some embodiments the game may be ended by a set amount of time passing, a threshold score being reached, or a threshold number of shots being hit. When the game has ended the game server waits for another game selection in step 310 which will restart the game from step 310. The process of asynchronous play described above may be complete by multiple bays 100 individually. The bays specific game elements are displayed only to the bays while general shot renders are shown on a shared common display such as an end of range screen 116. This is evident from the other hitting stations shown in FIG. 10 which may be completing similar asynchronous gameplay methods simultaneously.

Turning now to FIG. 11, a partial synchronous game play method is shown. Partial synchronous game play methods may include bay-to-bay challenge which do not include all active bays 100. This scenario addresses a special case in which some hitting stations in bays 100 are linked and playing synchronously while one or more of the other hitting stations in bays 100 play asynchronously. For example in partial synchronous game play method five bays 100 on each floor may be playing a game of darts against each other, while the other 15 bays on each floor are playing only among and between the players in a single bay 100. The partial synchronous game play method may be initiated by elective challenges such as when the venue announces a game and invites each bay 100 to participate in partial synchronous game play. In another embodiment individual bays 100 may directly challenge other bays 100 via messaging over a display 108 or other input device in the bays 100. In partial synchronous game play a bay 100 or users controlling the bay 100 could indicate that the bay 100 is available for or interested in bay-to-bay competitions or that the bay 100 has opted of bay-to-bay competitions.

As shown in FIG. 11, the process for a partial synchronous game play method begins with step 400 wherein a player, bay 100 or manager selects a game or activity and invites qualifying bays 100 or hitting stations to participate. When the invitation is sent a countdown timer may limit the window for hitting stations to opt into the game. After the countdown timer expires, the game would begin. In step 402, one or more bays receive an invitation to participate in the game. The bays 100 may opt in or out of the game. If a bay elects not to participate then the bay will return asynchronous play as shown in step 404. If a bay does elect to participate as shown in step 406 then the bays that have elected to play wait to see is a synchronous play threshold is met. The synchronous gameplay threshold may be a minimum number of bays required. The threshold may also have a time limit in which it must be met. If the threshold is not met as shown in step 408 then the process proceeds to send the bays that elected to participate back to asynchronous play in step 410. If the threshold is met as shown in step 412 then the bays that have elected to participate will proceed into step 414. In step 414 the game server loads a pre-configured game and issues instructions to participating game client stations in each bay 100. The instructions to participating game client stations instruct the bays 100 to display game-specific configuration shared field of play to each of the bays 100. Then with a common field of play between the participating bays 100 the process proceeds to step 416 wherein the participating bays 100 commence play. Play starts by the bay 100 informing players in the bay which player hits next. Next in step 418 the selected players hit shots.

When the player hits a ball, the hitting station identifies the ball launch event and sends launch parameters to shot server in step 420. If a multi-station sensor is present when the ball is launched, then in step 422 the shot server will wait for pre-defined amount of time for additional data on ball flight. The data from the ball flight and ball launch may be collected by a range sensor system 112 and an in-bay sensor system 110. If available ball launch and ball flight data is sufficient for a shot to be rendered by the system, then the shot server will render the shot in step 424. The shot server creates the render or complete view of the ball flight from the hitting station within the bay 100 through the physical game area and into the virtual field of play or digital game area. After the shot is rendered, the process proceeds to step 426 where the complete rendered ball flight data is sent to a game logic server. In step 428 the game logic server takes the rendered shot and evaluates the shot relative to game parameters, objectives, and game environment to determine game result from the rendered shot. The process then will proceed to step 432.

If after step 422 data is not available to allow a shot to be rendered, then in step 430 the shot server rejects the insufficient available data and transmits the launch event to the game server without a rendered ball flight and the game server applies game rules to result the launch event. The process will then skip to step 432. In step 432 render data from the corresponding shot and launch event are sent to pre-assigned displays 108. If the process followed step 430 then step 432 may entail rendering a shot message relevant to the failed shot onto a display. If the process followed step 424 then step 432 may entail rendering a shot onto a display. The process of calculating and rendering the ball flight will occur for each player that has hit a ball in partial synchronous play. The displays may include station specific field of play displays, an end of range screen 116, a hitting station display 108, a hitting station specific secondary display, other venue data displays which generally show other game information such as game score, active players and stations and related statistics. The displays receiving render information may also include the player's mobile devices. After the render data has been sent to the pre-assigned displays, the game may continue in step 434 wherein the game server updates the game client station in each bay 100 with shot data from players in other participating bays 100. Then in step 436 the game client renders all the shots from all participating bays on some or all station specific displays and secondary displays. In some embodiments the partial synchronous game may also display game play objects 111 specific to the partial synchronous game play on a portion of the common field of play.

After the shots are rendered the process proceeds to step 438 where the game logic server and/or game client station renders game information to one or more secondary displays bay displays 109, and/or user mobile devices. As shown in step 440 the secondary displays may show live, updating game results and standings relative to a prize or game winning number of points. The secondary displays may also show a game time or shots-remaining before game expiration. In step 442 the bay 100 or hitting station may have lights that may be activated to highlight particularly good or bad shots. The lights may indicate hitting position standings relative to the game objective. In some embodiments this may include a hitting station with most points in a points-maximization game being lit one color such as green, while the station with the least points another color such as red. After these indicators are displayed, game may continue or may be ended depending on the game state. In step 444 the game will continue by returning to step 416 and continuing the process forward from step 416. When the game has ended, the process will proceed to step 446 wherein the game server locks-out additional shots and presents the final results to the players in the different participating bays 100. In some embodiments the game may be ended by a set amount of time passing, a threshold score being reached, or a threshold number of shots being hit. When the game has ended the Game server waits for another game selection in step which will restart the game by returning the process to step 400. In this manner one embodiment of a partial synchronous game play method in a golf and entertainment facility 10 is shown.

As used herein, the term "computer" may refer, but is not limited to a laptop or desktop computer, or a mobile device, such as a desktop, laptop, tablet, cellular phone, smart phone, personal media user (e.g., iPod), wearable computer, implantable computer, or the like. Such computing devices may operate using one or more operating systems, including, but not limited to, Windows, MacOS, Linux, Unix, iOS, Android, Chrome OS, Windows Mobile, Windows CE, Windows Phone OS, Blackberry OS, and the like.

As used herein, the term "mobile device" may refer, but is not limited to any computer, as defined herein, that is not fixed in one location. Examples of mobile devices include smart phones, personal media users, portable digital assistants, tablet computers, wearable computers, implanted computers, laptop computers, and wearable technologies, such as helmets, glasses or googles.

The system and process described herein may be deployed in part or in whole through network infrastructures. The network infrastructure may include elements such as computing devices, servers, routers, hubs, firewalls, clients, personal computers, communication devices, routing devices and other active and passive devices, modules and/or components as known in the art. The computing and/or non-computing device(s) associated with the network infrastructure may include, apart from other components, a storage medium such as flash memory, buffer, stack, RAM, ROM and the like. The processes, methods, program codes, instructions described herein and elsewhere may be executed by one or more of the network infrastructural elements.

The computer software, program codes, and/or instructions may be stored and/or accessed on machine readable media that may include: computer components, devices, and recording media that retain digital data used for computing for some interval of time; semiconductor storage known as random access memory (RAM); mass storage typically for more permanent storage, such as optical discs, forms of magnetic storage like hard disks, tapes, drums, cards and other types; processor registers, cache memory, volatile memory, non-volatile memory; optical storage such as CD, DVD; removable media such as flash memory (e.g. USB sticks or keys), floppy disks, magnetic tape, paper tape, punch cards, standalone RAM disks, Zip drives, removable mass storage, off-line, and the like; other computer memory such as dynamic memory, static memory, read/write storage, mutable storage, read only, random access, sequential access, location addressable, file addressable, content addressable, network attached storage, storage area network, bar codes, magnetic ink, and the like.

The systems and/or processes described herein, and steps thereof, may be realized in hardware, software or any combination of hardware and software suitable for a particular application. The hardware may include a general-purpose computer and/or dedicated computing device or specific computing device or particular aspect or component of a specific computing device. The processes may be realized in one or more microprocessors, microcontrollers, embedded microcontrollers, programmable digital signal processors or other programmable device, along with internal and/or external memory. The processes may also, or instead, be embodied in an application specific integrated circuit, a programmable gate array, programmable array logic, or any other device or combination of devices that may be configured to process electronic signals. It will further be appreciated that one or more of the processes may be realized as a computer executable code capable of being executed on a machine-readable medium.

The computer executable code may be created using a structured programming language such as C, an object oriented programming language such as .NET and C++, a lightweight data-interchange programming language such as JavaScript Object Notation (JSON) data-interchange format over HTTP POST request/response, or any other high-level or low-level programming language (including assembly languages, hardware description languages, and database programming languages and technologies) that may be stored, compiled or interpreted to run on one of the above devices, as well as heterogeneous combinations of processors, processor architectures, or combinations of different hardware and software, or any other machine capable of executing program instructions.

Thus, in one aspect, each process described above and combinations thereof may be embodied in computer executable code that, when executing on one or more computing devices, performs the steps thereof. In another aspect, the processes may be embodied in systems that perform the steps thereof and may be distributed across devices in a number of ways, or all of the functionality may be integrated into a dedicated, standalone device or other hardware. In another aspect, the means for performing the steps associated with the processes described above may include any of the hardware and/or software described above. All such permutations and combinations are intended to fall within the scope of the present disclosure.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

It is to be understood that were the specification or claims refer to relative terms, such as "front," "rear," "lower," "upper," "horizontal," "vertical," "above," "below," "up," "down," "top," "bottom," "left," and "right" as well as derivatives thereof (e.g., "horizontally," "downwardly," "upwardly" etc.), such reference is used for the sake of clarity and not as terms of limitation, and should be construed to refer to the orientation as then described or as shown in the drawings under discussion. These relative terms are for convenience of description and do not require that the apparatus be constructed or the process to be operated in a particular orientation.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Processes of the instant disclosure may be implemented by performing or completing manually, automatically, or a combination thereof, selected steps or tasks.

The term "process" may refer to manners, means, techniques and procedures for accomplishing a given task including, but not limited to, those manners, means, techniques and procedures either known to, or readily developed from known manners, means, techniques and procedures by practitioners of the art to which the invention belongs.

For purposes of the instant disclosure, the term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. Terms of approximation (e.g., "about", "substantially", "approximately", etc.) should be interpreted according to their ordinary and customary meanings as used in the associated art unless indicated otherwise. Absent a specific definition and absent ordinary and customary usage in the associated art, such terms should be interpreted to be ±10% of the base value.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a process comprising two or more defined steps, the defined steps can be carried out in any order or simultaneously (except where context excludes that possibility), and the process can also include one or more other steps which are carried out before any of the defined steps, between two of the defined steps, or after all of the defined steps (except where context excludes that possibility).

Still further, additional aspects of the instant invention may be found in one or more appendices attached hereto and/or filed herewith, the disclosures of which are incorporated herein by reference as if fully set out at this point.

Thus, the present invention is well adapted to carry out the objects and attain the ends and advantages mentioned above as well as those inherent therein. While the inventive concept has been described and illustrated herein by reference to certain illustrative embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A synchronous game play method comprising the steps of:

electronically receiving a game selection from a game logic server;

electronically receiving an election to participate in the game selection from two or more bay stations located in a golf and entertainment facility;

digitally rendering a common, interactive field of play comprising a digital game area displayed on a physical, shared, and interactive game area or range surface extending from said bay stations and a shared, interactive range-surrounding screen positioned about the interactive range surface;

electronically identifying ball launch events from each of the participating bay stations using a plurality of sensors;

electronically calculating ball flights from said ball launch events with a game shot server;

digitally rendering the calculated ball flights sequentially and/or simultaneously on the interactive range surface and the interactive range-surrounding screen;

electronically sending the calculated ball flights from the game shot server to the game logic server;

evaluating the calculated ball flights relative to game parameters for the game selection and the digital game area to determine a game result based on the ball launch events;

electronically sending the game result from the game logic server to each of the participating bay stations;

repeating the method from the ball launch events until the determined game result meets a game ending parameter for the game selection; and electronically sending a game ending results from the game logic server to each of the participating bay stations and to the interactive range-surrounding display.

2. The method of claim 1 further comprising the steps of electronically detecting the ball launch events using the sensors comprising an in-bay sensor system and a range sensor system, and calculating the launched ball flights using launch parameters sensed by the in-bay sensor system and using flight parameters sensed by the range sensor system.

3. The method of claim 1 further comprising digitally rendering the calculated ball flights on displays located in each of the two or more participating bay stations.

4. The method of claim 1 wherein each of the two or more participating bay stations display a modified view of the digital game area specific to the synchronous gameplay.

5. The method of claim 4 wherein the two or more participating bay stations comprise all bay stations that are active in the golf and entertainment facility.

6. The method of claim 1 wherein one or more visual adjustments specific to an active player are presented and applied to each of the participating bay stations based on user input data.

7. The method of claim 1 wherein one or more other bay stations elect not to participate in the game selection with the two or more bay stations.

8. The method of claim 7 wherein the one or more other bay stations not to participate in the selected game engage in unique-to-bay asynchronous gameplay.

9. The method of claim 8 wherein each of the one or more other bay stations display a modified view of the digital game area specific to the asynchronous gameplay.

* * * * *